US007221346B2

(12) United States Patent
Wang et al.

(10) Patent No.: US 7,221,346 B2
(45) Date of Patent: May 22, 2007

(54) DRIVING CIRCUIT OF LIQUID CRYSTAL DISPLAY DEVICE

(75) Inventors: Ching-Tung Wang, Jhubei (TW); Jui-Lung Hung, Fangwan Township, Jhanghua County (TW)

(73) Assignee: Toppoly Optoelectronics Corp., Chunan Miaoli (TW)

( * ) Notice: Subject to any disclaimer, the term of this patent is extended or adjusted under 35 U.S.C. 154(b) by 429 days.

(21) Appl. No.: 10/705,887

(22) Filed: Nov. 13, 2003

(65) Prior Publication Data

US 2004/0233149 A1 Nov. 25, 2004

(30) Foreign Application Priority Data

May 23, 2003 (TW) ..... 92113958 A

(51) Int. Cl.
*G09G 3/36* (2006.01)

(52) U.S. Cl. ..... 345/87; 345/94; 345/89; 345/99

(58) Field of Classification Search ..... 345/87–89, 345/204, 96, 98, 675, 676, 660, 99; 382/167, 382/172, 287; 348/372
See application file for complete search history.

(56) References Cited

U.S. PATENT DOCUMENTS 6,160,532 A * 12/2000 Kaburagi et al. ..... 345/87
6,525,707 B1 * 2/2003 Kaneko et al. ..... 345/88
6,710,809 B1 * 3/2004 Niikawa ..... 348/372
2001/0015709 A1 * 8/2001 Imajo et al. ..... 345/87
2002/0005846 A1 * 1/2002 Hiroki et al. ..... 345/204
2002/0044126 A1 * 4/2002 Aoki ..... 345/96
2002/0080107 A1 * 6/2002 Fujimoto et al. ..... 345/87
2002/0093475 A1 * 7/2002 Hashimoto ..... 345/87
2002/0097208 A1 * 7/2002 Hashimoto ..... 345/87
2002/0126106 A1 * 9/2002 Naito ..... 345/204
2002/0140711 A1 * 10/2002 Saito et al. ..... 345/660
2002/0171613 A1 * 11/2002 Goto et al. ..... 345/87
2003/0020678 A1 * 1/2003 Ozawa et al. ..... 345/87
2003/0034942 A1 * 2/2003 Tjandra et al. ..... 345/87
2003/0058229 A1 * 3/2003 Kawabe et al. ..... 345/204
2003/0122757 A1 * 7/2003 Bu ..... 345/87
2003/0132903 A1 * 7/2003 Ueda ..... 345/87
2003/0156086 A1 * 8/2003 Maeda et al. ..... 345/89
2003/0169247 A1 * 9/2003 Kawabe et al. ..... 345/204
2004/0131279 A1 * 7/2004 Poor ..... 382/287
2004/0174328 A1 * 9/2004 Hudson ..... 345/87
2004/0196231 A1 * 10/2004 Goto et al. ..... 345/87
2004/0227713 A1 * 11/2004 Sun ..... 345/98
2005/0078101 A1 * 4/2005 Shigeta ..... 345/204
2005/0219188 A1 * 10/2005 Kawabe et al. ..... 345/94
2005/0244054 A1 * 11/2005 Hsieh ..... 382/167

* cited by examiner

*Primary Examiner*—Bipin Shalwala
*Assistant Examiner*—Prabodh Dharia
(74) *Attorney, Agent, or Firm*—Birch, Stewart, Kolasch & Birch, LLP

(57) ABSTRACT

A driving circuit used in a liquid crystal display device is disclosed which includes a timing controller, a source driver and a low color scale driving circuit. The timing controller outputs a polarity inverting signal, a first digital signal, a second digital signal, a third digital signal and a fourth digital signal. The low color scale driving circuit generates a first analog signal, a second analog signal, a third analog signal and a fourth analog signal according to the digital signals outputted from the timing controller for driving a liquid crystal panel. Through the low color scale driving circuit, power consumption of the liquid crystal display device reduces when operating in the condition of low color scale.

16 Claims, 4 Drawing Sheets

DRIVING CIRCUIT OF LIQUID CRYSTAL DISPLAY DEVICE

BACKGROUND OF THE INVENTION

1. Field of Invention

The present invention relates to a driving circuit of a liquid crystal display device, and more particularly to a low color scale driving circuit of a liquid crystal display device.

2. Related Art

A liquid crystal display device usually includes a pair of parallel glass substrates between which is provided the assembly at least of an indium tin oxide (ITO) film, an alignment film and a color filter. The slot directions of the alignment films are perpendicular to each other. A liquid crystal material is placed between the substrates along the slots of the alignment film. When an electric field is applied between the substrates, the liquid crystal molecules become vertical to the slots so that light cannot pass and consequently black color is shown on the display screen. Therefore, a display can be implemented through controlling the liquid crystal molecules according to the variation of the electric field.

FIG. 1 shows a driving circuit of a conventional liquid crystal display device. A driving circuit 100 includes a timing controller 110 and a source driver 120. The source driver 120 receives a digital image signal 302 from the timing controller 110 and accordingly generates an analog signal 303 for controlling a liquid crystal display panel 200. The timing controller 110 converts the image data into a digital image signal 302 and outputs the digital image signal 302 to the source driver 120. The timing controller 110 further outputs a control signal that is a polarity-inverting signal 301 for controlling the polarity of an analog voltage from the source driver 120.

A color display scheme with 8, 64 or 128 color scales usually uses a driving circuit having the above architectures. For a 256-color-scale display device, 8, 64, 128 and 256 color scales must be all included, which consumes higher electric power.

The number of color scales is one important factor that influences the display quality. The greater number of color scales, the higher power is needed. Although power consumption is not the most serious concern for a liquid crystal display device of a desktop computer, it may be critical for a small display device of a portable electronic device such as a cell phone, a personal digital assistant or a laptop computer.

Therefore, there is a need of a display device with lower power consumption, suitable for use in a portable electronic device.

SUMMARY OF THE INVENTION

It is therefore an object of the invention to provide a low color scale driving circuit of a liquid crystal display device to achieve power saving when a high color scale is not needed. Furthermore, the driving circuit is driven with lower power to overcome the problem of the prior art, caused by excessive power consumption of the driving circuit.

In order to achieve the above and other objectives, a low color scale driving circuit is implemented in a driving circuit, which further includes a timing controller and a source driver. The timing controller receives an image data and outputs a digital image signal, digital signals and a polarity-inverting signal. The source driver receives the digital image signal and generates an analog image signal.

The low color scale driving circuit outputs a first analog signal, a second analog signal, a third analog signal and a fourth analog signal according to the signals outputted from the timing controller. The low color scale driving circuit includes buffers, resistors and a plurality of sets of transistors. The buffers include at least a first buffer, a second buffer, a third buffer and a fourth buffer. Each buffer has a first input terminal, a second input terminal and an output terminal. The first input terminal of each buffer receives a polarity-inverting signal. The second input terminal of the first buffer receives a first digital signal. The second input terminal of the second buffer receives a second digital signal. The second input terminal of the third buffer receives a third digital signal. The second input terminal of the fourth buffer receives a fourth digital signal. Each set of transistors has PMOS transistor and NMOS transistor. For example, when four sets of transistors are provided, there are, totally, 8 transistors: a first PMOS transistor, a first NMOS transistor, a second PMOS transistor, a second NMOS transistor, a third PMOS transistor, a third NMOS transistor, a fourth PMOS transistor and a fourth NMOS transistor.

The architecture of the low color scale driving circuit according to the invention provides 2,8 or 64 color scales with low power consumption. It does not need an amplifier and a digital analog circuit (DAC) as required in the prior art, when the resolution of the liquid crystal display device is at 256 colors or higher. In the invention, the timing controller controls the color display with 64 color scales through only 4 data control signals, thereby, the pin count for the control signals is significantly lower than that used in the art.

BRIEF DESCRIPTION OF THE DRAWINGS

The present invention will become more fully understood from the detailed description given herein below illustration only, and is thus not limitative of the present invention.

DETAILED DESCRIPTION OF THE INVENTION

Figure 1:
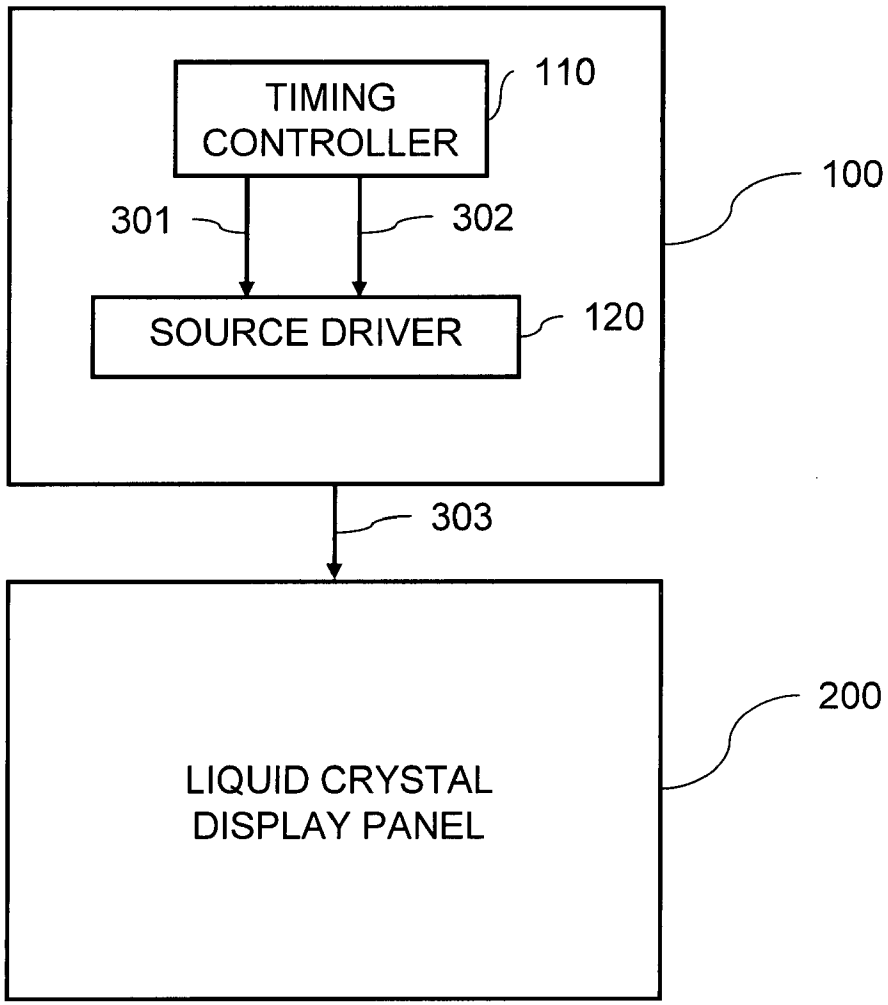
FIG. 1(PRIOR ART)
FIG. 1 is a block diagram of a driving circuit of a conventional liquid crystal display device.
Figure 2:
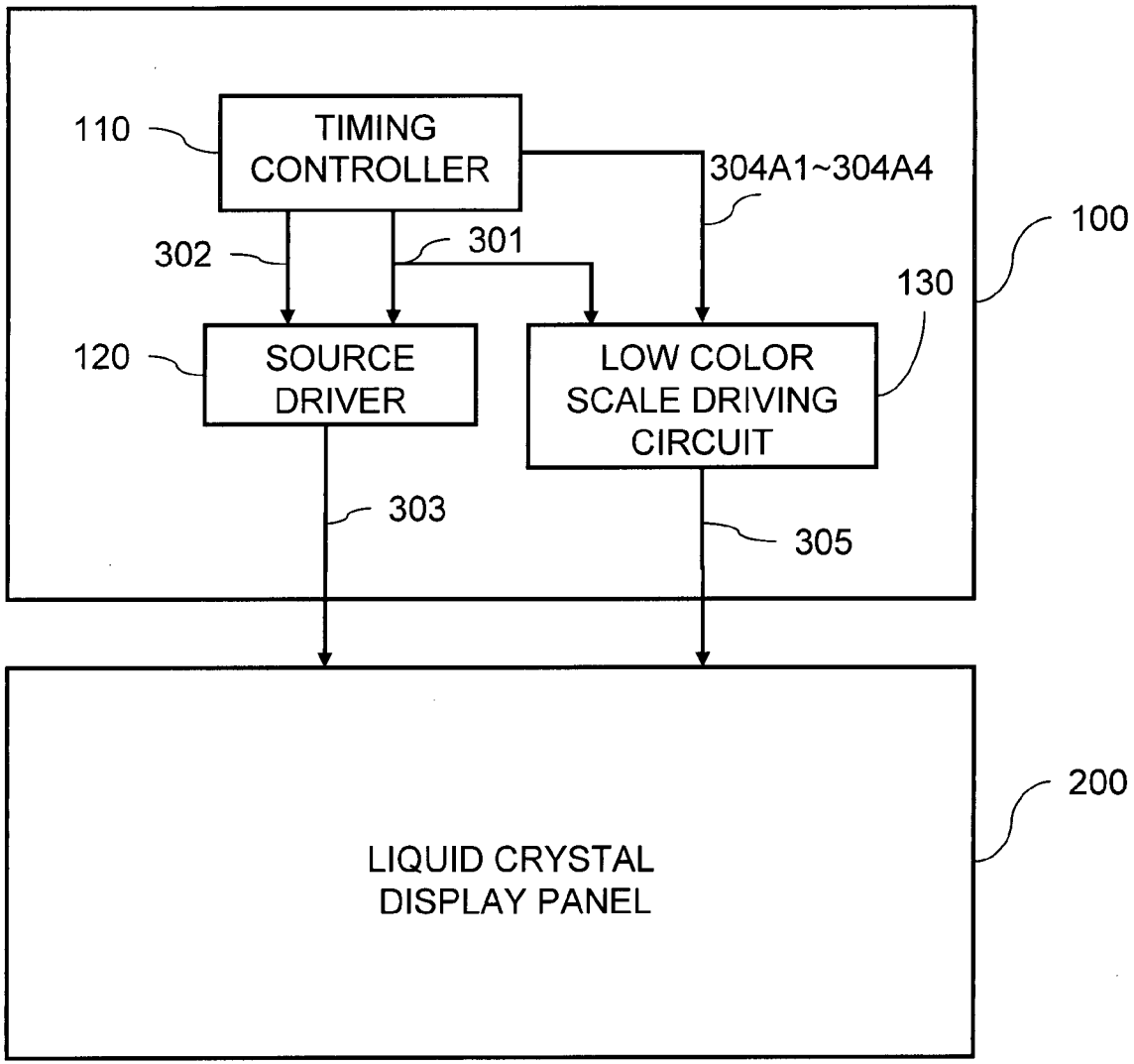
FIG. 2 is a block diagram of a driving circuit of a liquid crystal display device according to one embodiment of the invention.

FIG. 2 is a block diagram of a driving circuit used in a liquid crystal display device according to one embodiment of the invention. A driving circuit 100 used in the liquid crystal display device includes a timing controller 110, a source driver 120 and a low color scale driving circuit 130. The timing controller 110 receives an image data and outputs a digital image signal 302. The timing controller 110 further outputs a polarity-inverting signal 301. The source driver 120 receives a digital image signal 302 and generates an analog image signal 303. The low color scale driving circuit 130 delivers an analog signal 305 in response to the polarity-inverting signal 301 and a first digital signal 304A1, a second digital signal 304A2, a third digital signal 304A3 and a fourth digital signal 304A4.

Figure 3:
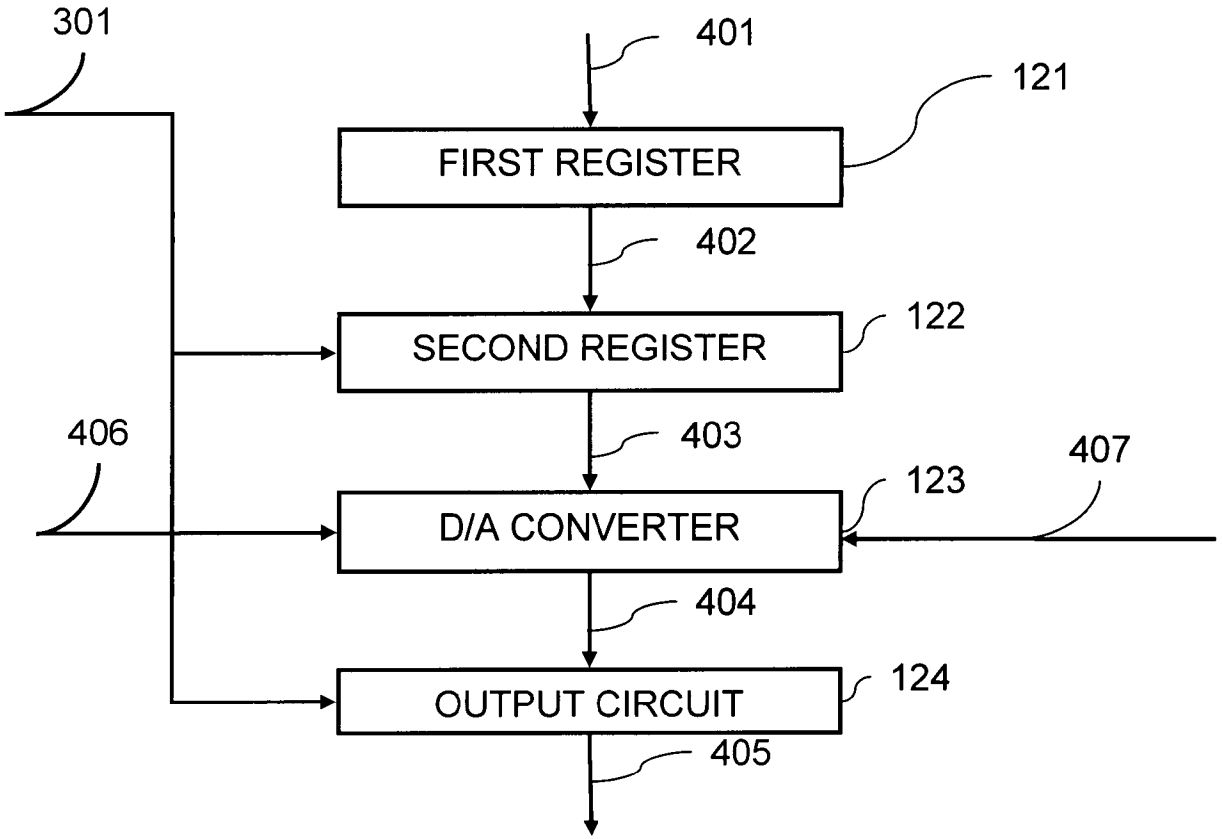
FIG. 3 is a functional block diagram of a source driver used in a liquid crystal display device according to one embodiment of the invention.

FIG. 3 illustrates a block diagram of the source driver 120. The source driver 120 includes a first register 121, a second register 122, a digital/analog (D/A) converter 123, and an output circuit 124. The first register 121 is a shift register, which is a data control unit. The second register 122 is a load register. When an input signal 401 passes through the first register 121, an output signal 402 is inputted into the second register 122, which then outputs a signal 403 to the D/A converter 123. The DA converter 123 then outputs an analog signal 404 according to the signal 403. The analog signal 404 is processed into the output circuit 124 to output a control signal 405. A reference voltage of the DA converter 123 in the source driver 120 is a polarity-inverting signal 301, as shown in FIG. 3, to determine a first adjustment voltage 406 or a second adjustment voltage 407.

Figure 4:
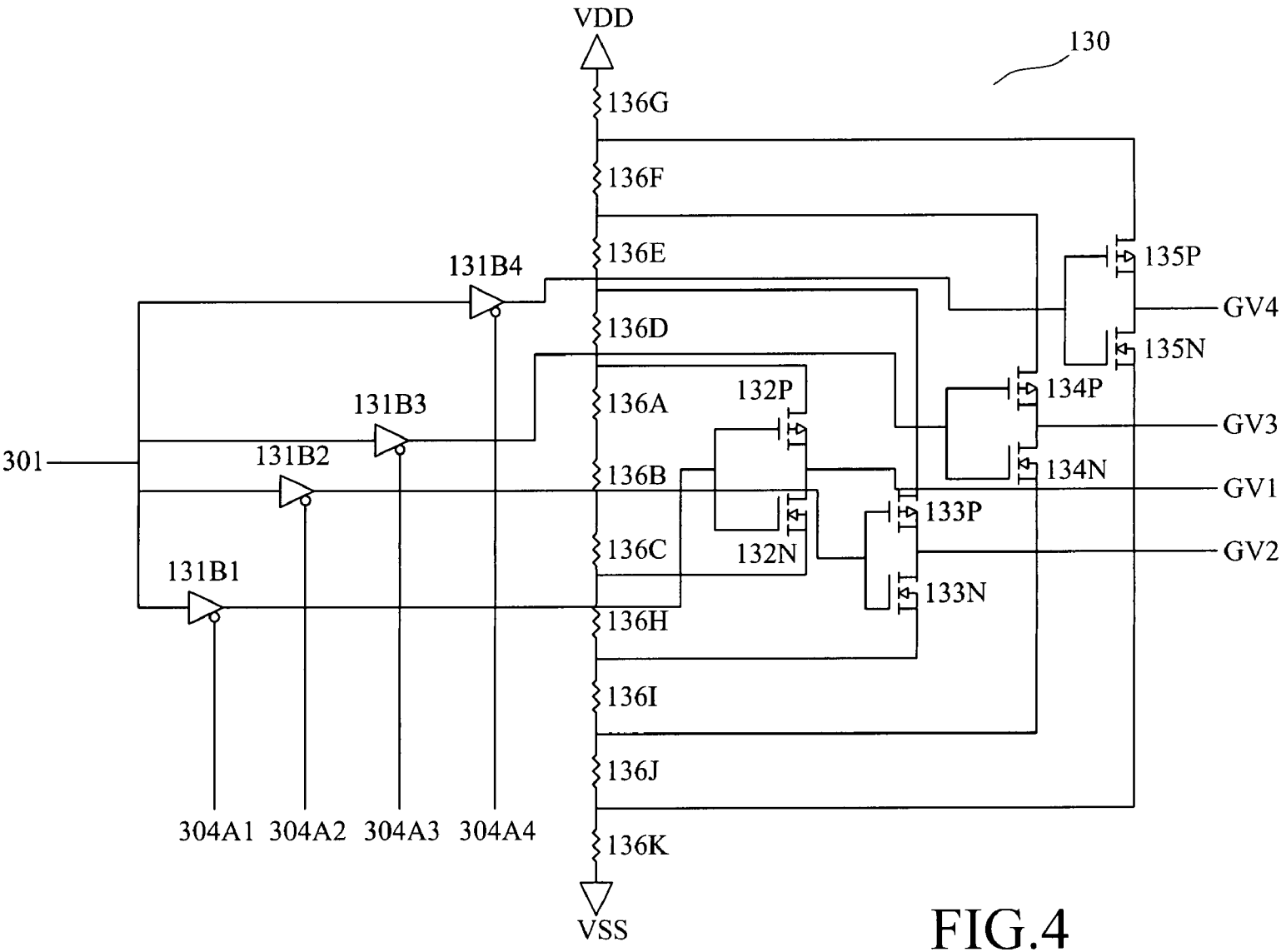
FIG. 4 is a block diagram of a low color scale circuit of a driving circuit used in a liquid crystal display device according to one embodiment of the invention.

FIG. 4 illustrates a scheme of a low color scale driving circuit. A low color scale driving circuit 130 respectively outputs a first analog signal GV 1, a second analog signal GV2, a third analog signal GV3 and a fourth analog signal GV4 according to a first digital signal 304A1, a second digital signal 304A2, a third digital signal 304A3 and a fourth digital signal 304A4. The low color scale driving circuit 130 includes buffers (131B1, 131B2, 131B3, 131B4), sets of transistors (132~135P, 132~135N), and resisters (136A~K).

The buffers include a first buffer 131B1, a second buffer 131B2, a third buffer 131B3 and a fourth buffer 131B4. Each buffer has a first input terminal, a second input terminal and an output terminal. The first input terminal of each buffer receives a polarity-inverting signal 301. The second input terminal of the first buffer 131B1 receives a first digital signal 304A1. The second input terminal of the second buffer 131B2 receives a second digital signal 304A2. The second input terminal of the third buffer 131B3 receives a third digital signal 304A3. The second input terminal of the fourth buffer 131B4 receives a fourth digital signal 304A4.

The first set of transistors includes a first PMOS transistor 132P and a first NMOS transistor 132N. A gate of the first PMOS transistor 132P and a gate of the first NMOS transistor 132N are coupled with the output terminal of the first buffer 131B 1. A source of the first PMOS transistor 132P is coupled with a drain of the first NMOS transistor 132N. A drain of the first PMOS transistor 132P is coupled with a power voltage VDD. A source of the NMOS transistor 132N is coupled with a ground voltage VSS. The first analog signal GV1 is outputted through the source of the first PMOS transistor 132P and the drain of the first NMOS transistor 132N.

The second set of transistors includes a second PMOS transistor 133P and a second NMOS transistor 133N. A gate of the second PMOS transistor 133P and a gate of the second NMOS transistor 133N are coupled with the output terminal of the second buffer 131B2. A source of the second PMOS transistor 133P is coupled with a drain of the second NMOS transistor 133N. A drain of the second NMOS transistor 133N is coupled with a ground voltage VSS. A drain of the second PMOS transistor 133P is coupled with a power voltage VDD. The second analog signal GV2 is outputted through the source of the second PMOS transistor 133P and the drain of the second NMOS transistor 133N.

The third set of transistors includes a third PMOS transistor 134P and a third NMOS transistor 134N. A gate of the third PMOS transistor 134P and a gate of the third NMOS transistor 134N are coupled with the output terminal of the third buffer 131B3. A source of the third PMOS transistor 134P is coupled with a drain of the third NMOS transistor 134N. A drain of the third PMOS transistor 134P is coupled with a power voltage VDD. A source of the third NMOS transistor 134N is coupled to a ground voltage VSS. The third analog signal GV3 is outputted through the source with the third PMOS transistor 134P and the drain of the third NMOS transistor 134N.

The fourth set of transistors includes a fourth PMOS transistor 135P and a fourth NMOS transistor 135N. A gate of the fourth PMOS transistor 135P and a gate of the fourth NMOS transistor 135N are coupled with the output terminal of the fourth buffer 131B4. A source of the fourth PMOS transistor 135P is coupled with a drain of the fourth NMOS transistor 135N. A drain of the fourth PMOS transistor 135P is coupled with a power voltage VDD. A source of the fourth NMOS transistor 135N is coupled with a ground voltage VSS. The fourth analog signal GV4 is outputted through the source of the fourth PMOS transistor 135P and the drain of the fourth NMOS transistor 135N.

Furthermore, three resistors 136A, 136B, 136C are connected in series between the drain of the first PMOS transistor 132P and the source of the first NMOS transistor 132N. A resistor 136D is further connected between the drain of the first PMOS transistor 132P and the drain of the second PMOS transistor 133P. A transistor 136E is further connected between the drain of the second PMOS transistor 133P and the drain of the third PMOS transistor 134P. A transistor 136F is further connected between the drain of the third PMOS transistor 134P and the drain of the fourth PMOS transistor 135P. A resistor 136G is connected between the fourth PMOS transistor 135P and the power voltage VDD. A resistor 136H is connected between the source of the first NMOS transistor 132N and the source of the second NMOS transistor 133N. A resistor 1361 is connected between the source of the second NMOS transistor 133N and the source of the third NMOS transistor 134N. A resistor 136J is connected between the source of the third NMOS transistor 134N and the source of the fourth NMOS transistor 135N. A resistor 136K is connected between the source of the fourth NMOS transistor 135N and the ground voltage VSS.

Each of the red, green and blue primary colors is defined by 4 bits, totaling 4×4×4=64 bits. However, the definition of one primary color is not done necessarily with 4 bits. The number of digital signals used to control the exhibition of color can be changed, depending on the demand of lower resolution. Sometimes, only one signal is needed.

The architecture of the driving circuit according to the invention does not need an amplifier and a digital analog circuit (DAC) as required in the prior art, when the resolution of the liquid crystal display device is at 256 colors or higher. In the invention, the timing controller controls the color exhibition with 64 color scales through only 4 data control signals, thereby the pin count for the control signals is significantly lower than that used in the prior art. The object of lower power consumption is achieved by implementing the driving circuit with an additional low color scale driving circuit. When the system operates with less color scale, the driving circuit uses the low color scale circuit to deliver analog signals.

Knowing the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving circuit of a liquid crystal display device comprising:

a timing controller outputting a polarity-inverting signal and at least one digital signal;

a source driver;

a low color scale driving circuit, wherein the low color scale driving circuit generates at least one analog signal and comprises:

at least one buffer, receiving the polarity-inverting signal and said at least one digital signal outputted from the timing controller; and at least one set of transistors, coupled to an output terminal of the buffer for outputting said analog signal, wherein said set of transistors comprises a PMOS transistor and a NMOS transistor, a gate of the PMOS transistor and a gate of the NMOS transistor coupled to the output terminal of the buffer, a source of the PMOS transistor coupled to the drain of the NMOS transistor, a drain of the PMOS transistor coupled to a power voltage, a source of the NMOS transistor coupled to a ground voltage, the analog signal outputted through the source of the PMOS transistor and the drain of the NMOS transistor.

2. A driving circuit of a liquid crystal display device including a timing controller, a source driver and a low color scale driving circuit, the timing controller outputting a polarity-inverting signal, a first digital signal, a second digital signal, a third digital signal and a fourth digital signal, the low color scale driving circuit generating a first analog signal, a second analog signal, a third analog signal and a fourth analog signal and comprising:

a plurality of buffers, receiving the polarity-inverting signal, the first digital signal, the second digital signal, the third digital signal and the fourth digital signal; and a plurality of sets of transistors which comprise a first set of transistors, a second set of transistors, a third set of transistors, and a fourth set of transistors, respectively coupled to an output terminal of the buffers for respectively outputting the first, second, third and fourth analog signal.

3. The driving circuit of claim 2, wherein the plurality of buffers include a first buffer, a second buffer, a third buffer and a fourth buffer, each of the buffers having a first input terminal, a second input terminal and the output terminal; the first input terminal of the each buffer receiving the polarity-inverting signal; the second input terminal of the first buffer receiving the first digital signal; the second input terminal of the second buffer receiving the second digital signal; the second input terminal of the third buffer receiving the third digital signal; the second input terminal of the fourth buffer receiving the fourth digital signal.

4. The driving circuit of claim 3, wherein the first set of transistors includes a first PMOS transistor and a first NMOS transistor; a gate of the first PMOS transistor and a gate of the first NMOS transistor coupled to the output terminal of the first buffer; a source of the first PMOS transistor coupled to a drain of the first NMOS transistor, a drain of the first PMOS transistor coupled to a power voltage, a source of the NMOS transistor coupled to a ground voltage, the first analog signal outputted through the source of the first PMOS transistor and the drain of the first NMOS transistor.

5. The driving circuit of claim 4, farther comprising three resistors connected in series between the drain of the first PMOS transistor and the source of the first NMOS transistor.

6. The driving circuit of claim 4, wherein the second set of transistors includes a second PMOS transistor and a second NMOS transistor, a gate of the second PMOS transistor and a gate of the second NMOS transistor coupled to the output terminal of the second buffer, a source of the second PMOS transistor coupled to a drain of the second NMOS transistor, a drain of the first PMOS transistor coupled to the power voltage, a drain of the second NMOS transistor coupled to the ground voltage, the second analog signal outputted through the source of the second PMOS transistor and the drain of the second NMOS transistor.

7. The driving circuit of claim 6, further comprising a resistor connected between the drain of the first PMOS transistor and the drain of the second PMOS transistor.

8. The driving circuit of claim 6, further comprising a resistor connected between the source of the first NMOS transistor and the source of the second NMOS transistor.

9. The driving circuit of claim 6, wherein the third set of transistors includes a third PMOS transistor and a third NMOS transistor, a gate of the third PMOS transistor and a gate of the third NMOS transistor coupled to the output terminal of the third buffer, a source of the third PMOS transistor coupled to a drain of the third NMOS transistor, a drain of the third PMOS transistor coupled to the power voltage, the source of the third NMOS transistor coupled to the ground voltage, the third analog signal outputted through the source of the third PMOS transistor and the drain of the third NMOS transistor.

10. The driving circuit of claim 9, further comprising a resistor connected between the drain of the second PMOS transistor and the drain of the third PMOS transistor.

11. The driving circuit of claim 9, further comprising a resistor connected between the source of the second NMOS transistor and the source of the third NMOS transistor.

12. The driving circuit of claim 9, wherein the fourth set of transistors includes a fourth PMOS transistor and a fourth NMOS transistor, a gate of the fourth PMOS transistor and a gate of the fourth NMOS transistor coupled to the output terminal of the fourth buffer, a source of the fourth PMOS transistor coupled to a drain of the fourth NMOS transistor, a drain of the fourth PMOS transistor coupled to the power voltage, a source of the fourth NMOS transistor coupled to the ground voltage, the fourth analog signal outputted through the source of the fourth PMOS transistor and the drain of the fourth NMOS transistor.

13. The driving circuit of claim 12, further comprising a resistor connected between the drain of the third PMOS transistor and the drain of the fourth PMOS transistor.

14. The driving circuit of claim 12, further comprising a resistor connected between the source of the third NMOS transistor and the source of the fourth NMOS transistor.

15. The driving circuit of claim 12, further comprising a resistor connected between the fourth PMOS transistor and the power voltage.

16. The driving circuit of claim 12, further comprising a resistor connected between the source of the fourth transistor and the ground voltage.

* * * * *